US011651721B1

(12) United States Patent
Zhang et al.

(10) Patent No.: US 11,651,721 B1
(45) Date of Patent: May 16, 2023

(54) DRIVING METHOD OF DISPLAY PANEL AND DRIVING APPARATUS

(71) Applicant: TCL China Star Optoelectronics Technology Co., Ltd., Guangdong (CN)

(72) Inventors: Yuning Zhang, Guangdong (CN); Yoongu Kim, Guangdong (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/898,505

(22) Filed: Aug. 30, 2022

(51) Int. Cl.
*G09G 3/20* (2006.01)

(52) U.S. Cl.
CPC ..... *G09G 3/2007* (2013.01); *G09G 2360/16* (2013.01)

(58) Field of Classification Search
None
See application file for complete search history.

(56) References Cited

U.S. PATENT DOCUMENTS

2020/0312256 A1* 10/2020 Lin ..... G09G 3/3648
2021/0049969 A1* 2/2021 Wang ..... G09G 3/3688
2021/0157608 A1* 5/2021 Yu ..... G06F 9/44505

* cited by examiner

*Primary Examiner* — Matthew Yeung

(57) ABSTRACT

A driving method of the display panel and a driving apparatus are provided. The method includes: during a display period of one frame, acquiring an actual charge grayscale of a pixel unit of an Nth row and a target grayscale of a pixel unit of an N+1th row, wherein the pixel unit of the Nth row and the pixel unit of the N+1th row are connected to a same data line; according to the actual charge grayscale of the pixel unit of the Nth row and the target grayscale of the pixel unit of the N+1 th row, acquiring an over drive grayscale of the pixel unit of the N+1 th row; and driving the pixel unit of the N+1 th row using the over drive grayscale. Thus, the over drive grayscale of the pixel unit of the N+1 th row is more accurate, thereby increasing a charge rate of the pixel unit.

16 Claims, 4 Drawing Sheets

DRIVING METHOD OF DISPLAY PANEL AND DRIVING APPARATUS

RELATED APPLICATION

This application claims priority to a Chinese Patent Application No. 202210814163.8 filed on Jul. 11, 2022, the disclosure of which is incorporated in their entirety by reference herein.

FIELD OF DISCLOSURE

The present disclosure relates to a technical field of displays, and more particularly to a driving method of a display panel and a driving apparatus.

BACKGROUND OF DISCLOSURE

With continuous development in the panel industry, display panels with large sizes, high resolutions and high refresh rates are more and more favored by consumers. However, along with increase in sizes, resolutions and refresh rates also come a technology problem of pixels being incompletely charged.

SUMMARY OF DISCLOSURE

In the present disclosure, a driving method of a display panel and a driving apparatus are provided to solve a problem of pixels being incompletely charged in the related art.

The present disclosure provides a driving method of a display panel including:

during a display period of one frame, acquiring an actual charge grayscale of a pixel unit of an Nth row and a target grayscale of a pixel unit of an N+1 th row, wherein the pixel unit of the Nth row and the pixel unit of the N+1 th row are connected to a same data line;

according to the actual charge grayscale of the pixel unit of the Nth row and the target grayscale of the pixel unit of the N+1 th row, acquiring an over drive grayscale of the pixel unit of the N+1 th row;

and driving the pixel unit of the N+1 th row using an over drive voltage corresponding to the over drive grayscale, wherein N is an integer greater than or equal to 1.

Optionally, in some embodiments of the present disclosure, the step of acquiring an actual charge grayscale of a pixel unit of an Nth row that is connected to a same data line includes:

acquiring a target grayscale of the pixel unit of the Nth row, an over drive grayscale of the pixel unit of the Nth row, and an over drive compensation coefficient of the pixel unit of the Nth row; and according to the target grayscale of the pixel unit of the Nth row, the over drive grayscale of the pixel unit of the Nth row, and the over drive compensation coefficient of the pixel unit of the Nth row, calculating the actual charge grayscale of the pixel unit of the Nth row.

Optionally, in some embodiments of the present disclosure, a formula for calculating the actual charge grayscale of the pixel unit of the Nth row is as follows: $P+|(Q-P)|\times R$, where P is the target grayscale of the pixel unit of the Nth row, Q is the over drive grayscale of the pixel unit of the Nth row, and R is the over drive compensation coefficient.

Optionally, in some embodiments of the present disclosure, a value range of the over drive compensation coefficient is −1 to 1.

Optionally, in some embodiments of the present disclosure, the over drive compensation coefficient is acquired according to a pre-experiment.

Optionally, in some embodiments of the present disclosure, in the pre-experiment, the over drive compensation coefficient is acquired by the following steps:

setting a predetermined over drive compensation coefficient and calculating an actual charge grayscale of the pixel unit of the Nth row according to the above calculation formula;

determining an over drive grayscale of the pixel unit of the N+1th row by looking up a standard over drive lookup table using the actual charge grayscale of the pixel unit of the Nth row and the target grayscale of the pixel unit of the N+1th row.

driving the pixel unit of the N+1 th row using the over drive grayscale; if a displayed image of the display panel is normal, determining the predetermined over drive compensation coefficient to be the over drive compensation coefficient, and if the displayed image of the display panel is abnormal, adjusting the predetermined over drive compensation coefficient; and repeating the above steps until the over drive compensation coefficient is determined.

Optionally, in some embodiments of the present disclosure, when the over drive grayscale of the pixel unit of the Nth row is a positive voltage, the over drive compensation coefficient is a first compensation coefficient, and when the over drive grayscale of the pixel unit of the Nth row is a negative voltage, the over drive compensation coefficient is a second compensation coefficient, and wherein the first compensation coefficient and the second compensation coefficient are not equal to each other.

Optionally, in some embodiments of the present disclosure, the driving method of the display panel further includes:

storing the standard over drive lookup table corresponding to the display panel and the over drive compensation coefficient.

Correspondingly, the present disclosure also provides a driving apparatus configured to drive a display panel, wherein the driving apparatus includes:

a first acquiring module configured to, during a display period of one frame, acquire an actual charge grayscale of a pixel unit of an Nth row and a target grayscale of a pixel unit of an N+1 th row, wherein the pixel unit of the Nth row and the pixel unit of the N+1 th row are connected to a same data line;

a second acquiring module connected to the first acquiring module and configured to, according to the actual charge grayscale of the pixel unit of the Nth row and the target grayscale of the pixel unit of the N+1th row, acquire an over drive grayscale of the pixel unit of the N+1 th row; and a driving module configured to drive the pixel unit of the N+1 th row using the over drive grayscale.

Optionally, in some embodiments of the present disclosure, the first acquiring module includes an acquiring unit and a calculating unit;

wherein the acquiring unit is configured to acquire a target grayscale of the pixel unit of the Nth row, an over drive grayscale of the pixel unit of the Nth row, and an over drive compensation coefficient of the pixel unit of the Nth row; and wherein the calculating unit is configured to, according to the target grayscale of the pixel unit of the Nth row, the over drive grayscale of the pixel unit of the Nth row, and the over drive compensation coefficient of the pixel unit of the Nth row, calculate the actual charge grayscale of the pixel unit of the Nth row.

Optionally, in some embodiments of the present disclosure, the driving apparatus further includes a storage module, and wherein the storage module is configured to store a standard over drive lookup table corresponding to the display panel and the over drive compensation coefficient.

The present disclosure provides a driving method of the display panel and a driving apparatus. The driving method of the display panel includes: during a display period of one frame, acquiring an actual charge grayscale of a pixel unit of an Nth row and a target grayscale of a pixel unit of an N+1 th row, wherein the pixel unit of the Nth row and the pixel unit of the N+1 th row are connected to a same data line; according to the actual charge grayscale of the pixel unit of the Nth row and the target grayscale of the pixel unit of the N+1 th row, acquiring an over drive grayscale of the pixel unit of the N+1 th row; and driving the pixel unit of the N+1th row using the over drive grayscale, wherein N is an integer greater than or equal to 1. In the present disclosure, according to the actual charge grayscale of the pixel unit of the Nth row and the target grayscale of the pixel unit of the N+1 th row, the over drive grayscale of the pixel unit of the N+1th row is determined, causing the over drive grayscale of the pixel unit of the N+1th row to be more accurate and thus increasing a charge rate of the pixel unit.

DESCRIPTION OF DRAWINGS

In order to describe technical solutions in embodiments more clearly, drawings required to be used by the embodiments are briefly introduced below. Obviously, the drawings in the description below are only some embodiments of the present disclosure. With respect to persons skilled in the art, under a premise that inventive efforts are not made, other drawings can be obtained based on these drawings.

DETAILED DESCRIPTION OF EMBODIMENTS

Technical solutions in the embodiments of the present disclosure will be described clearly and completely hereinafter with reference to the accompanying drawings in the embodiments of the present disclosure. Apparently, the described embodiments are merely some rather than all embodiments of the present disclosure. All other embodiments obtained by persons skilled in the art on the basis of the embodiments of the present disclosure without creative efforts shall fall within the protection scope of the present disclosure.

In the description of the present disclosure, the following should be understood. The terms "first" and "second" are only used for description purpose, and cannot be considered as indicating or implying relative importance or implicitly pointing out the number of relevant technical features. Thus, features being respectively defined as "first" and "second" can each expressly or implicitly include at least one of the features, and thus the terms "first" and "second" should not be construed as limitations to the present disclosure. In addition, the following should be noted. Unless otherwise definitely specified and defined, the terms "connected", "connection", etc. should be interpreted broadly, for example, as a mechanical connection, or an electrical connection; as being directly connected or being indirectly connected through an intervening medium; and as an internal connection between two elements. To persons skilled in the art, the specific meanings of the aforementioned terms in the present disclosure can be appreciated on the basis of corresponding specific situations.

The present disclosure provides a driving method of the display panel and a driving apparatus, which are to be described in detail below. It should be noted that a description order of the following embodiments is not intended to limit a preference order of the embodiments of the present disclosure.

Figure 1:
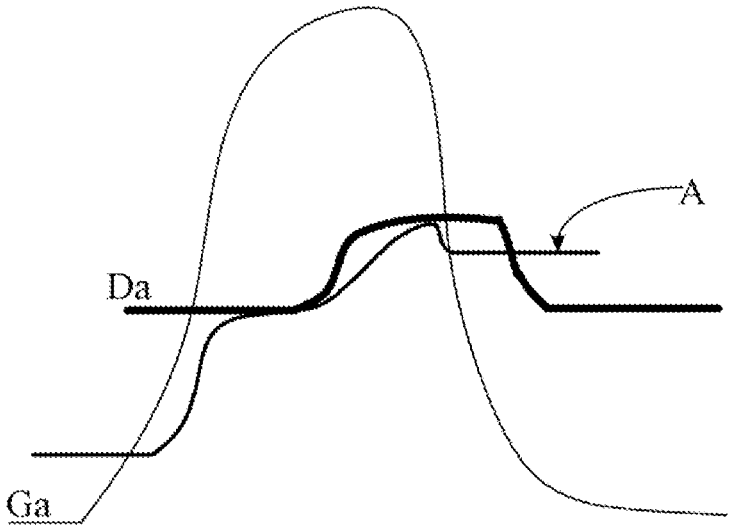
FIG. 1 is a schematic diagram illustrating, under an ideal condition, a charging of a pixel unit provided by the present disclosure.
Figure 2:
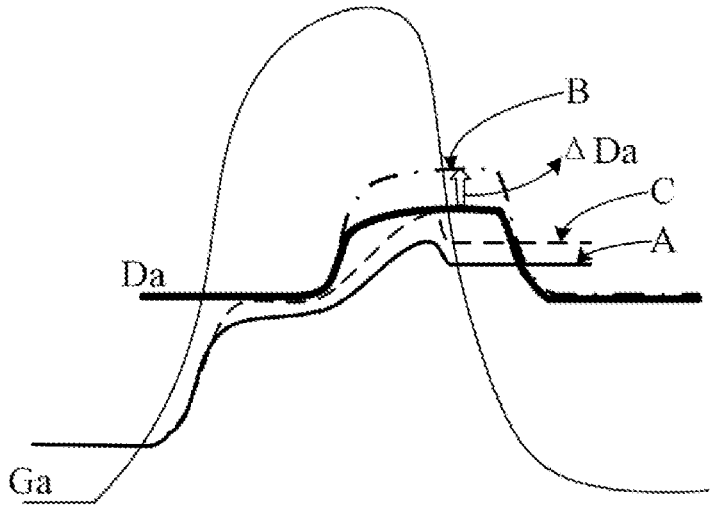
FIG. 2 is a schematic diagram illustrating, in a practical application, a charging of a pixel unit provided by the present disclosure.
Figure 3:
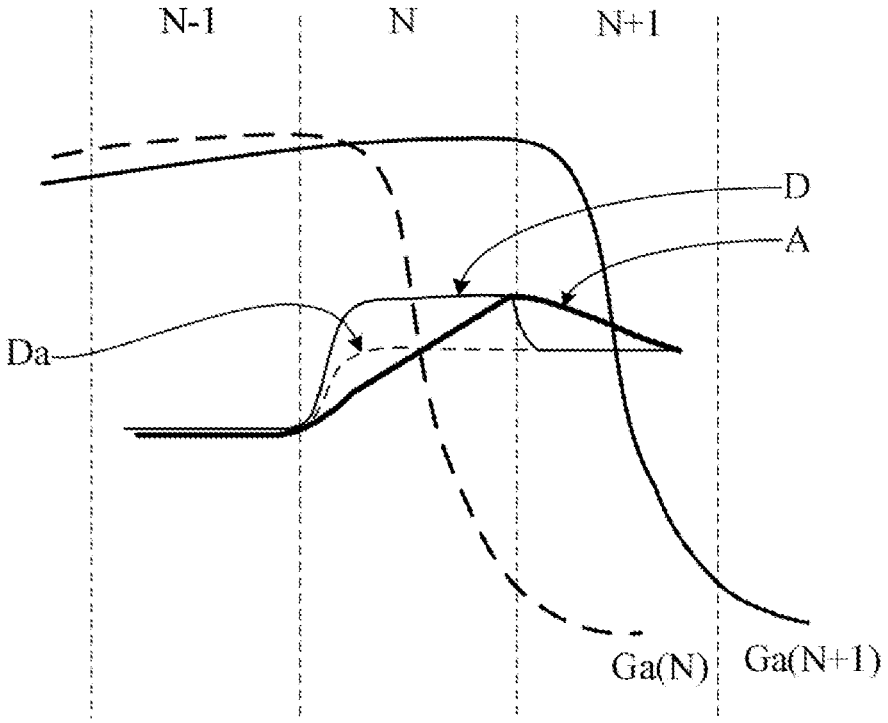
FIG. 3 is a schematic diagram illustrating signal compensation provided by the present disclosure.

Referring to FIGS. 1 to 3, FIG. 1 is a schematic diagram illustrating, under an ideal condition, a charging of a pixel unit provided by the present disclosure. FIG. 2 is a schematic diagram illustrating, in a practical application, a charging of a pixel unit provided by the present disclosure. FIG. 3 is a schematic diagram illustrating signal compensation provided by the present disclosure.

As illustrated in FIG. 1, a curve A represents an actually-charged voltage of the pixel unit. When a scan line outputs a scan signal Ga, a data line outputs a target data voltage Da to a corresponding pixel unit. Under an ideal condition, the pixel unit can be charged to the target data voltage Da for normal display. The target data voltage Da is a drive voltage corresponding to a target grayscale to be displayed by the pixel unit. For example, if image display data input to a display panel is in 8-bit binary format, 2 to the 8th power of grayscales with darkest to brightest luminance are generated. That is, 256 grayscales (denoted, for example, as 0th grayscale to 255th grayscale) with different luminance are generated. Of course, the image display data received by the display panel of the present disclosure can also be in 6-bit binary format, 10-bit binary format, or the like.

However, in a practical application, a target data signal Da on a data line needs to be switched from a target grayscale corresponding to a pixel unit of a previous row to a target grayscale corresponding to a pixel unit of a current row. Thus, if the data line only provides a corresponding target drive voltage Da to the pixel unit of the current row, because of slow response speed of liquid crystal deflection, the target grayscale that is actually needed by the pixel unit of the current row cannot be actually reached.

Specifically, as illustrated in FIG. 2, the curve A represents an actually-charged voltage of the pixel unit. A curve B represents a data voltage after data is boosted. A curve C represents, after the data is boosted, a charged voltage of the pixel unit. It can be known that if the data line only transmits the corresponding target drive voltage Da to the pixel unit of the current row, the actually-charged voltage cannot reach the target data voltage Da. After data boost is performed on the target data voltage Da that is input, a charge rate of the pixel unit is increased, causing a pixel electrode to be charged to the target drive voltage Da. A data boost part ΔDa is a part for which the pixel unit of the current row needs to be compensated.

In order to solve the aforementioned problem, in the past, an inventor uses line over drive (line OD) technology to compensate drive of a pixel for the pixel being insufficiently charged. A compensation principle of the line OD technology is as follows: For a same data line, a voltage value corresponding to a next target grayscale and a voltage value corresponding to a current target grayscale is compared. A drive voltage that corresponds to an over drive grayscale and is greater than a drive voltage that corresponds to a target grayscale of the current row is provided, thereby speeding up liquid crystal deflection speed and thus achieving the target grayscale of the current row.

However, through practice, it is found that a compensation method of the related line OD technology has problems such as a compensation value being inaccurate, a pixel being incompletely charged, or a pixel being over charged. For example, as illustrated in FIG. 3, a curve A represents an actually-charged voltage of the pixel unit. A curve D represents an over drive voltage. For a same data line, when an Nth scan line outputs an Nth scan signal Ga(N), the data line is configured to output, according to a target grayscale corresponding to a pixel unit of an N−1 th row and a target grayscale corresponding to a pixel unit of an Nth row, an over drive voltage that is greater than a voltage value of a target data voltage Da corresponding to the pixel unit of the Nth row, as illustrated by the curve D. When the Nth scan signal Ga(N) becomes a low level, the pixel unit of the Nth row stops being charged and is overcharged. That is, the actually-charged voltage of the pixel unit of the Nth row is greater than the target data voltage Da of the pixel unit of the Nth row, as illustrated by the curve A.

Further, when a target grayscale of a pixel unit of an N+1th row is equal to the target grayscale corresponding to the pixel unit of the Nth row, the target data voltage Da of the pixel unit of the N+1 th row is equal to the target data voltage Da of the pixel unit of the Nth row. At this time, no over drive compensation is needed for the pixel unit of the N+1 th row. That is, the over drive voltage output from the data line to the pixel unit of the N+1 th row is equal to the target data voltage Da of the pixel unit of the N+1 th row. But actually, because the actually-charged voltage of the pixel unit of the Nth row is greater than the target data voltage Da of the pixel unit of the Nth row, when the N+1 th scan signal Ga(N+1) becomes a low level, the pixel unit of the N+1 th row stops being charged and is overcharged. That is, the actually-charged voltage of the pixel unit of the N+1 th row is greater than the target data voltage Da of the pixel unit of the N+1th row, as illustrated by the curve A. Thus, both the pixel unit of the Nth row and the pixel unit of the N+1 th row have the problem of being inaccurately charged.

In this regard, a driving method of a display panel is provided by the present disclosure. First, during a display period of one frame, an actual charge grayscale of a pixel unit of an Nth row and a target grayscale of a pixel unit of an N+1th row are acquired, wherein the pixel unit of the Nth row and the pixel unit of the N+1 th row are connected to a same data line. Then, according to the actual charge grayscale of the pixel unit of the Nth row and the target grayscale of the pixel unit of the N+1 th row, an over drive grayscale of the pixel unit of the N+1th row is acquired. Finally, the pixel unit of the N+1th row is driven using the over drive grayscale, wherein N is an integer greater than or equal to 1.

Figure 4:
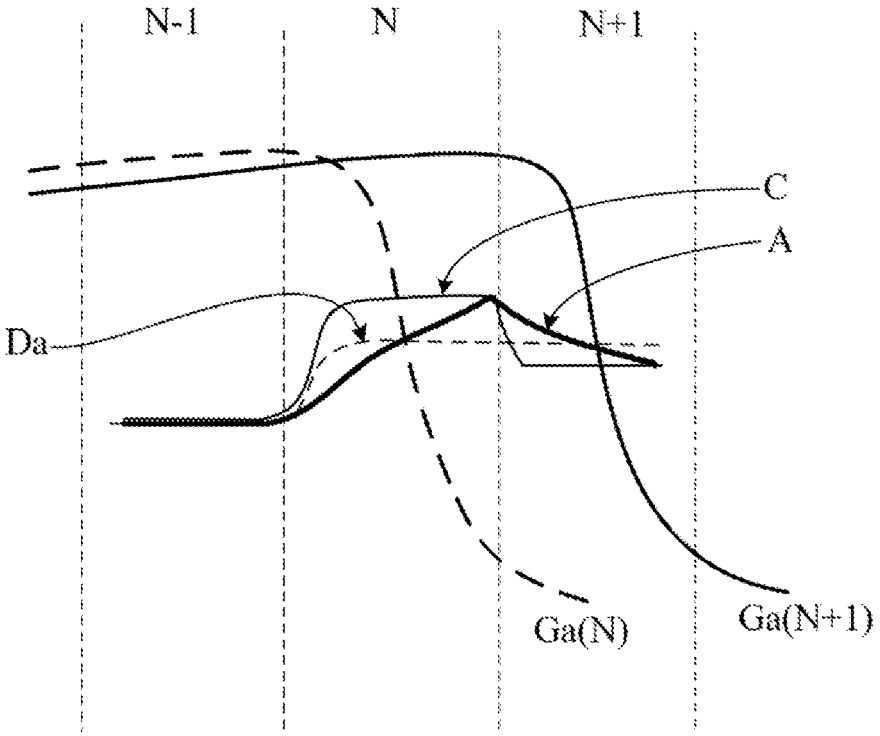
FIG. 4 is a schematic diagram illustrating signal compensation of the driving method of the display panel provided by the present disclosure.

Specifically, referring to FIG. 4, FIG. 4 is a schematic diagram illustrating signal compensation of the driving method of the display panel provided by the present disclosure. When an N+1 th scan line outputs an N+1 th scan signal Ga(N+1), a data line is configured to output, according to an actual charge grayscale corresponding to a pixel unit of an Nth row and a target grayscale corresponding to a pixel unit of an N+1th row, an over drive voltage corresponding to an over drive grayscale of the pixel unit of the N+1 th row, as illustrated by a curve C. It can be known that the over drive voltage of the pixel unit of the N+1 th row is less than a target data voltage Da (a drive voltage corresponding to the target grayscale) corresponding to the pixel unit of the N+1 th row. When the N+1 th scan signal Ga(N+1) becomes a low level, the pixel unit of the N+1th row stops being charged and is charged to a target voltage corresponding to the target grayscale.

In embodiments of the present disclosure, according to the actual charge grayscale of the pixel unit of the N−1 th row and the target grayscale of the pixel unit of the Nth row, the over drive grayscale of the pixel unit of the Nth row is determined, causing the over drive grayscale of the pixel unit of the Nth row to be more accurate and thus increasing a charge rate of the pixel unit.

Details are described below.

Figure 5:
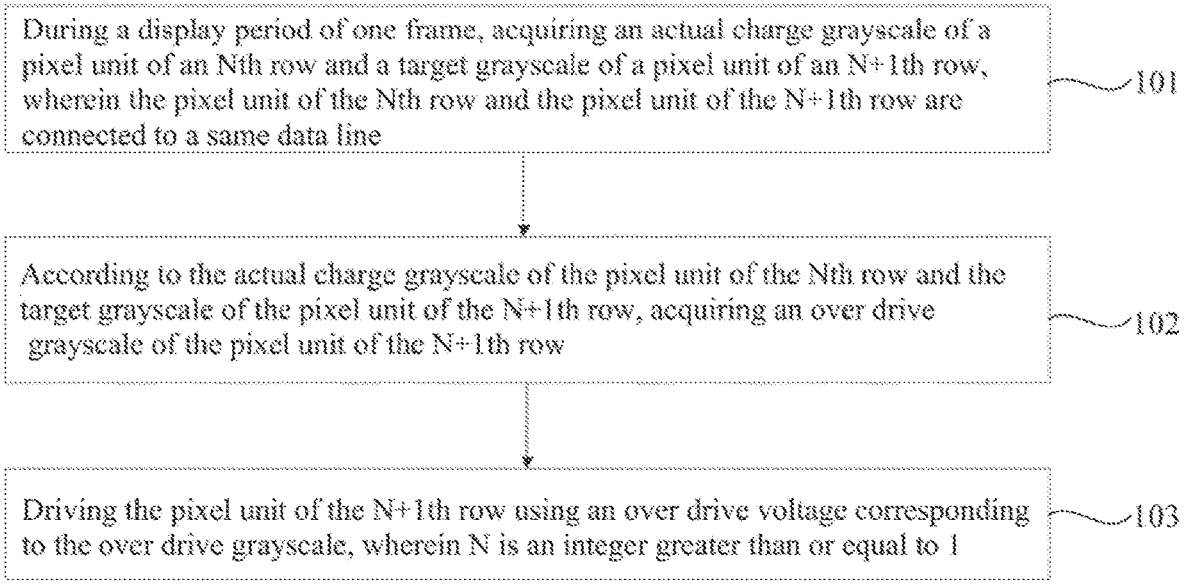
FIG. 5 is a schematic flowchart of a driving method of a display panel provided by the present disclosure.

Referring to FIG. 5, FIG. 5 is a schematic flowchart of a driving method of a display panel provided by the present disclosure. As illustrated in FIG. 5, the driving method of the display panel includes the following steps:

In step 101, during a display period of one frame, an actual charge grayscale of a pixel unit of an Nth row and a target grayscale of a pixel unit of an N+1 th row are acquired, wherein the pixel unit of the Nth row and the pixel unit of the N+1 th row are connected to a same data line.

The actual charge grayscale of the pixel unit of the Nth row can be detected according to a detection circuit, calculated by a related algorithm, or acquired according to a pre-experimental test. The present disclosure does not specific limit this. The target grayscale of the pixel unit of the N+1 th row can be acquired according to image display data that is during a display period of a current frame and is received by the display panel.

Specifically, in some embodiments, the step of acquiring an actual charge grayscale of a pixel unit of an Nth row that is connected to a same data line can include the following steps:

In step 1011, a target grayscale of the pixel unit of the Nth row, an over drive grayscale of the pixel unit of the Nth row, and an over drive compensation coefficient of the pixel unit of the Nth row are acquired.

The target grayscale of the pixel unit of the Nth row can be acquired according to image display data that is during a display period of a current frame and is received by the display panel. The over drive grayscale of the pixel unit of the Nth row can be acquired by looking up a standard over drive lookup table corresponding to the display panel using a target grayscale of a pixel unit of an N−1th row and the target grayscale of the pixel unit of the Nth row. The over drive compensation coefficient can be acquired according to a pre-experiment.

The standard over drive lookup table is used to record various combinations of different target grayscales of a current row and different target grayscales of a next row, and an over drive grayscale corresponding to each of the combinations. Thus, the over drive grayscale of the pixel unit of the Nth row can be found in the standard over drive lookup table using the target grayscale of pixel unit of the N−1th row and the target grayscale of the pixel unit of the Nth row. Then, an over drive voltage corresponding to the over drive grayscale can be used to drive liquid crystal deflection, achieving over drive.

In step 1012, according to the target grayscale of the pixel unit of the Nth row, the over drive grayscale of the pixel unit of the Nth row, and the over drive compensation coefficient of the pixel unit of the Nth row, the actual charge grayscale of the pixel unit of the Nth row is calculated.

In an embodiment, a formula for calculating the actual charge grayscale of the pixel unit of the Nth row can be as follows: $P+|(Q-P)|\times R$, where P is the target grayscale of the pixel unit of the Nth row, Q is the over drive grayscale of the pixel unit of the Nth row, and R is the over drive compensation coefficient.

According to the above formula, the step 1012 can include the following steps:

In step 1012A, an absolute value of a difference between the over drive grayscale of the pixel unit of the Nth row and the target grayscale of the pixel unit of the Nth row is acquired.

Specifically, subtraction between the over drive grayscale of the pixel unit of the Nth row and the target grayscale of the pixel unit of the Nth row is performed to acquire the difference between the over drive grayscale of the pixel unit of the Nth row and the target grayscale of the pixel unit of the Nth row. The absolute value of the difference is taken.

In step 1012B, a product of the absolute value of the difference and the over drive compensation coefficient is acquired.

Specifically, multiplication of the absolute value of the difference by the over drive compensation coefficient is performed to acquire the product, wherein the absolute value of the difference is acquired by the step 1012A. It should be noted that the product acquired in step 1012B may be a non-integer. An approximate integer grayscale of the non-integer can be taken.

In step 1012C, a sum of the target grayscale of the pixel unit of the Nth row and the product is calculated to acquire the actual charge grayscale of the pixel unit of the Nth row.

Specifically, addition of the product acquired in the step 1012B and the target grayscale of the pixel unit of the Nth row is performed to acquire the actual charge grayscale of the pixel unit of the Nth row.

In embodiments of the present disclosure, a value range of the over drive compensation coefficient is −1 to 1. For example, the over drive compensation coefficient can be −1, −0.8, −0.5, −0.2, 0.2, 0.5, 0.8, 1, or the like. It can be known from the formula for calculating the actual charge grayscale of the pixel unit of the Nth row that the actual charge grayscale of the pixel unit of the Nth row can be greater than the target grayscale of the pixel unit of the Nth row. That is, there is a problem of over charging. The actual charge grayscale of the pixel unit of the Nth row can also be less than the target grayscale of the pixel unit of the Nth row. That is, there is a problem of insufficient charging. A value of the over drive compensation coefficient can be specifically designed according to an actual charge rate of the pixel unit.

In the present embodiments, when the over drive compensation coefficient is determined in the pre-experiment, the over drive compensation coefficient can be adjusted according to the aforementioned calculation formula. The following can be understood. It can be known from the above calculation formula that by changing the over drive compensation coefficient, the actual charge grayscale that is of the pixel unit of the Nth row and is different is acquired.

In this regard, in the pre-experiment, the over drive compensation coefficient can be acquired by the following steps:

First, a predetermined over drive compensation coefficient is determined, and an actual charge grayscale of the pixel unit of the Nth row is calculated according to the above calculation formula. Then, an over drive grayscale of the pixel unit of the N+1 th row is acquired by looking up the standard over drive lookup table using the actual charge grayscale of the pixel unit of the Nth row that is calculated and the target grayscale of the pixel unit of the N+1th row. Then, when the over drive grayscale is used to drive the pixel unit of the N+1 th row, whether a displayed image is normal or not, such as whether color of the display image is normal or not, is observed, to determine whether the over drive compensation coefficient is appropriate or not. If the displayed image of the display panel is normal, the predetermined over drive compensation coefficient is determined to be the over drive compensation coefficient. If the displayed image is abnormal (e.g., the displayed image has color-shift), the over drive compensation coefficient is adjusted. The above steps are repeated until the displayed image is normal, and the over drive compensation coefficient is determined to be appropriate.

In some embodiments of the present disclosure, because of process reasons, different pixel units may have different charge capabilities. Thus, in some embodiments, corresponding over drive compensation coefficients can be set according to charging capabilities of pixel units in different areas.

In some embodiments, an average value of the over drive compensation coefficients corresponding to the pixel units that are different can be selected as the over drive compensation coefficient, to reduce complexity of the driving method of the display panel.

In some embodiments of the present disclosure, the display panel can have a corresponding over drive compensation coefficient for positive data voltage, and another corresponding over drive compensation coefficient for negative data voltage. Because of a liquid crystal characteristic, it is necessary to keep alternately providing the positive and negative voltage to every pixel unit. The positive voltage has a voltage value greater than a common voltage, and the negative voltage has a voltage value less than the common voltage.

Specifically, when the drive voltage corresponding to the over drive grayscale of the pixel unit of the Nth row is the positive voltage, the over drive compensation coefficient is a first compensation coefficient. When the drive voltage corresponding to the over drive grayscale of the pixel unit of the Nth row is the negative voltage, the over drive compensation coefficient is a second compensation coefficient. The first compensation coefficient and the second compensation coefficient are not equal to each other.

The following can be understood. In the display panel, when every pixel unit is driven, a scan signal is provided by a scan line of a corresponding row to control that a thin film transistor (TFT) is turned on, and an over drive voltage is provided by a data line of a corresponding column to control current output by the TFT, to charge every pixel unit. When the over drive voltage of the pixel unit of the Nth row is the positive voltage, a gate-source voltage of the TFT is Vgs (positive)=Vg-Vs(positive). When the over drive voltage of the pixel unit of the Nth row is the negative voltage, the gate-source voltage of the TFT is Vgs(negative)=Vg-Vs (negative). Because a voltage value of the common voltage is often greater than or equal to zero, Vgs(positive)<Vgs (negative). From a current characteristic of the TFT, it can be known that when the gate-source voltage of the TFT changes, a charge rate changes. Thus, there is a difference in the charge rate of the pixel unit of the Nth row between when the over drive voltage of the pixel unit of the Nth row is the positive voltage and when the over drive voltage of the pixel unit of the Nth row is the negative voltage. Under a normal condition, the charge rate corresponding to when the over drive voltage of the pixel unit of the Nth row is the positive voltage is less than the charge rate corresponding to when the over drive voltage of the pixel unit of the Nth row is the negative voltage. Thus, the first compensation coefficient and the second compensation coefficient are usually set so that the first compensation coefficient is greater than the second compensation coefficient. Of course, the present disclosure is not limited thereto.

In embodiments of the present disclosure, by setting the first compensation coefficient and the second compensation coefficient not equal to each other, a difference in charging between the pixel unit having the data voltage with a polarity and the pixel unit having the data voltage with a different polarity is reduced, thereby further increasing accuracy of the over drive grayscale of the pixel unit of the N+1th row and thus enhancing an image display effect.

In step 102, according to the actual charge grayscale of the pixel unit of the Nth row and the target grayscale of the pixel unit of the N+1 th row, an over drive grayscale of the pixel unit of the N+1th row is acquired.

Specifically, the over drive grayscale of the pixel unit of the N+1 th row can be acquired by looking up the standard over drive lookup table using the actual charge grayscale of the pixel unit of the Nth row and the target grayscale of the pixel unit of the N+1 th row.

In step 103, the pixel unit of the N+1th row is driven using an over drive voltage corresponding to the over drive grayscale, wherein N is an integer greater than or equal to 1.

Specifically, a scan signal is output by an N+1 th scan line, and the over drive grayscale of the pixel unit of the N+1th row is output from the data line to the corresponding pixel unit of the N+1 th row, to charge the pixel unit of the N+1 th row.

In embodiments of the present disclosure, the driving method of the display panel further includes a step in which the standard over drive lookup table corresponding to the display panel and the over drive compensation coefficient are stored. Thus, when the driving method of the display panel in each of the foregoing embodiments is implemented, the standard over drive lookup table and the over drive compensation coefficient can be directly read.

The following should be noted. In embodiments of the present disclosure, because no over drive compensation is performed on a pixel unit of a 1st row, there is no corresponding over drive grayscale for the pixel unit of the 1st row. The foregoing can also be understood as the following: an over drive grayscale corresponding to the pixel unit of the 1st row is a target grayscale corresponding to the pixel unit of the 1st row. Of course, in some embodiments, a charge rate of the pixel unit of the 1st row can be detected, and then over drive compensation is performed on the pixel unit of the 1st row according to the charge rate of the pixel unit of the 1st row. Thus, when N is equal to 1, the solutions provided by the present disclosure can also be used. Details are omitted here.

Figure 6:
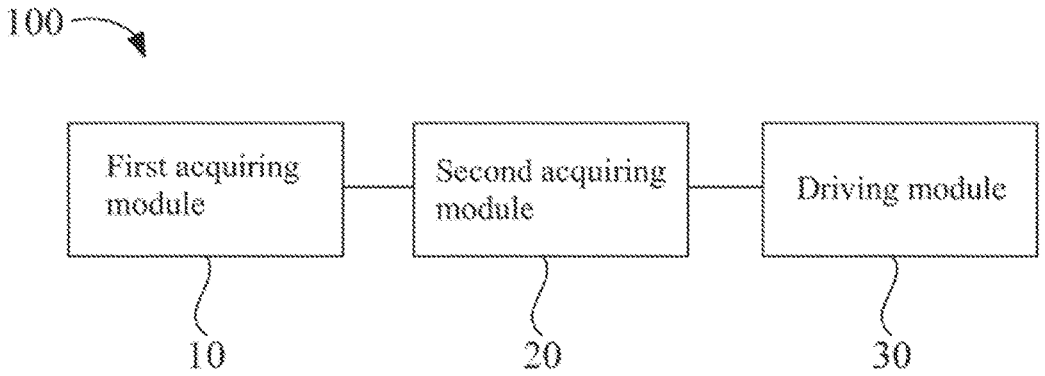
FIG. 6 is a schematic diagram illustrating a first structure of a driving apparatus provided by the present disclosure.

Referring to FIG. 6, FIG. 6 is a schematic diagram illustrating a first structure of a driving apparatus provided by the present disclosure. In embodiments of the present disclosure, a driving apparatus 100 of the display panel is also provided. The driving apparatus 100 includes a first acquiring module 10, a second acquiring module 20, and a driving module 30.

The first acquiring module 10 is configured to, during a display period of one frame, acquire an actual charge grayscale of a pixel unit of an Nth row and a target grayscale of a pixel unit of an N+1 th row, wherein the pixel unit of the Nth row and the pixel unit of the N+1 th row are connected to a same data line.

Specifically, the first acquiring module 10 can include a detection circuit or an algorithm module. Thus, the first acquiring module 10 can acquire the actual charge grayscale of the pixel unit of the Nth row by detection using the detection circuit or by calculation using a related algorithm. Of course, the actual charge grayscale of the pixel unit of the Nth row can also be acquired according to a pre-experiment, and the actual charge grayscale of the pixel unit of the Nth row is stored in the driving apparatus 100.

The second acquiring module 20 is connected to the first acquiring module 10 and is configured to, according to the actual charge grayscale of the pixel unit of the Nth row and the target grayscale of the pixel unit of the N+1th row, acquire an over drive grayscale of the pixel unit of the N+1 th row.

Specifically, the second acquiring module 20 can acquire the over drive grayscale of the pixel unit of the N+1 th row by looking up a standard over drive lookup table using the actual charge grayscale of the pixel unit of the Nth row and the target grayscale of the pixel unit of the N+1 th row.

The driving module 30 is configured to drive the pixel unit of the N+1 th row using the over drive grayscale. The driving module 30 can include a driving chip. Details are omitted here.

Figure 7:
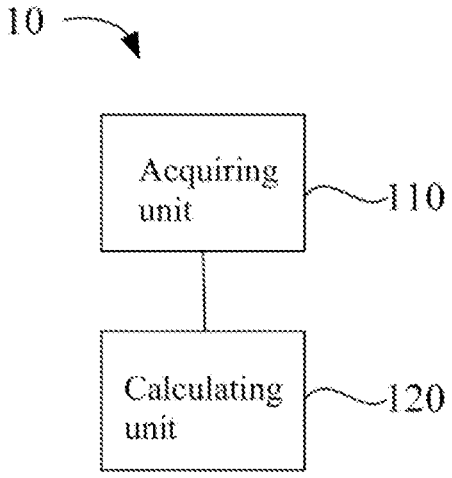
FIG. 7 is a schematic diagram illustrating a structure of a first acquiring module provided by the present disclosure.

Referring to FIG. 7, FIG. 7 is a schematic diagram illustrating a structure of the first acquiring module provided by the present disclosure. In some embodiments of the present disclosure, the first acquiring module 10 can include an acquiring unit 110 and a calculating unit 120.

The acquiring unit 110 is configured to acquire a target grayscale of the pixel unit of the Nth row, an over drive grayscale of the pixel unit of the Nth row, and an over drive compensation coefficient of the pixel unit of the Nth row.

Specifically, the acquiring unit 110 can acquire the target grayscale of the pixel unit of the Nth row according to image display data that is during a display period of a current frame and is received by the display panel. The acquiring unit 110 can acquire the over drive grayscale of the pixel unit of the Nth row by looking up the standard over drive lookup table corresponding to the display panel using a target grayscale of a pixel unit of an N−1 th row and the target grayscale of the pixel unit of the Nth row.

The calculating unit 120 is configured to, according to the target grayscale of the pixel unit of the Nth row, the over drive grayscale of the pixel unit of the Nth row, and the over drive compensation coefficient of the pixel unit of the Nth row, calculate the actual charge grayscale of the pixel unit of the Nth row.

Specifically, a formula for calculating the actual charge grayscale of the pixel unit of the Nth row can be as follows: $P+|(Q-P)|\times R$, where P is the target grayscale of the pixel unit of the Nth row, Q is the over drive grayscale of the pixel unit of the Nth row, and R is the over drive compensation coefficient. The calculating unit 120 can calculate the actual charge grayscale of the pixel unit of the Nth row according to the above calculation formula.

For an acquiring method of the over drive compensation coefficient, refer to the foregoing embodiments. Details are omitted here.

Figure 8:
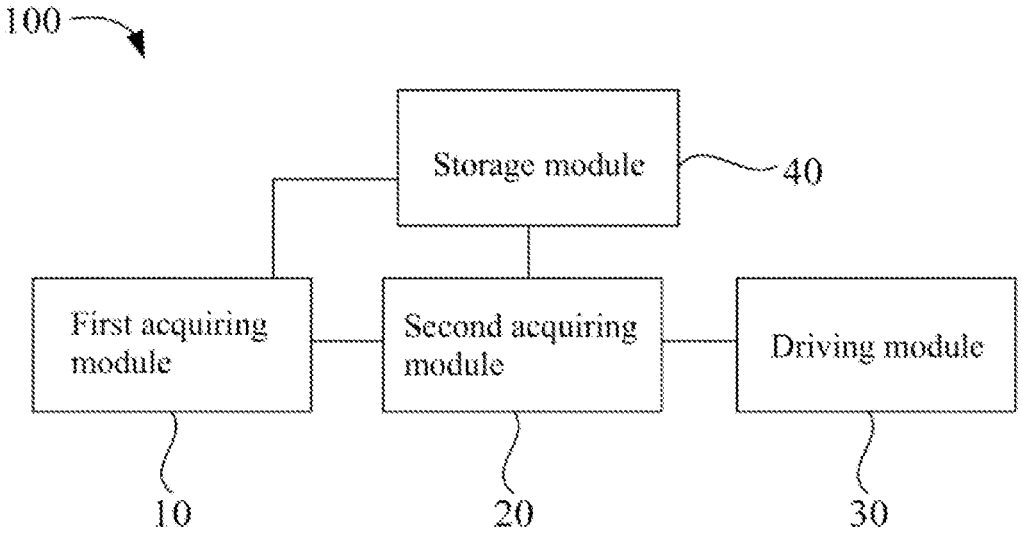
FIG. 8 is a schematic diagram illustrating a second structure of the driving apparatus provided by the present disclosure.

Referring to FIG. 8, FIG. 8 is a schematic diagram illustrating a second structure of the driving apparatus provided by the present disclosure. In some embodiments of the present disclosure, the driving apparatus 100 further includes a storage module 40. The storage module 40 is configured to store the standard over drive lookup table corresponding to the display panel and the over drive compensation coefficient in each of the foregoing embodiments. The first acquiring module 10 and the second acquiring module 20 are both connected to the storage module 40 to acquire the standard over drive lookup table and the over drive compensation coefficient.

In embodiments of the present disclosure, the driving apparatus 100 can further include a timing controller. The first acquiring module 10 and the second acquiring module 20 can be disposed in the timing controller.

In embodiments of the present disclosure, according to the actual charge grayscale of the pixel unit of the Nth row and the target grayscale of the pixel unit of the N+1 th row, the driving apparatus 100 determines the over drive grayscale of the pixel unit of the N+1th row, causing the over drive grayscale in line OD technology to be more accurate and thus increasing a charge rate of the pixel unit.

The driving method of the display panel and the driving apparatus provided by the embodiments of the present disclosure have been described in detail above. The principles and implementation manners of the present disclosure are described herein using specific examples. The description of the foregoing embodiments is only for facilitating understanding the present disclosure. At the same time, for those skilled in the art, changes in specific embodiments and application scope can be made on the basis of the idea of the present disclosure. In summary, content of the present specification should not be construed as limitations to the present disclosure.

What is claimed is:

1. A driving method of the display panel, comprises:

during a display period of one frame, acquiring an actual charge grayscale of a pixel unit of an Nth row and a target grayscale of a pixel unit of an N+1th row, wherein the pixel unit of the Nth row and the pixel unit of the N+1th row are connected to a same data line;

according to the actual charge grayscale of the pixel unit of the Nth row and the target grayscale of the pixel unit of the N+1 th row, acquiring an over drive grayscale of the pixel unit of the N+1th row; and driving the pixel unit of the N+1 th row using an over drive voltage corresponding to the over drive grayscale, wherein N is an integer greater than or equal to 1.

2. The driving method of the display panel of claim 1, wherein the step of acquiring an actual charge grayscale of a pixel unit of an Nth row that is connected to a same data line comprises:

acquiring a target grayscale of the pixel unit of the Nth row, an over drive grayscale of the pixel unit of the Nth row, and an over drive compensation coefficient of the pixel unit of the Nth row; and according to the target grayscale of the pixel unit of the Nth row, the over drive grayscale of the pixel unit of the Nth row, and the over drive compensation coefficient of the pixel unit of the Nth row, calculating the actual charge grayscale of the pixel unit of the Nth row.

3. The driving method of the display panel of claim 2, wherein a formula for calculating the actual charge grayscale of the pixel unit of the Nth row is as follows: $P+|(Q-P)|\times R$, where P is the target grayscale of the pixel unit of the Nth row, Q is the over drive grayscale of the pixel unit of the Nth row, and R is the over drive compensation coefficient.

4. The driving method of the display panel of claim 3, wherein a value range of the over drive compensation coefficient is −1 to 1.

5. The driving method of the display panel of claim 3, wherein the over drive compensation coefficient is acquired according to a pre-experiment.

6. The driving method of the display panel of claim 5, wherein in the pre-experiment, the over drive compensation coefficient is acquired by the following steps:

setting a predetermined over drive compensation coefficient and calculating an actual charge grayscale of the pixel unit of the Nth row according to the above calculation formula;

determining an over drive grayscale of the pixel unit of the N+1 th row by looking up a standard over drive lookup table using the actual charge grayscale of the pixel unit of the Nth row and the target grayscale of the pixel unit of the N+1th row;

driving the pixel unit of the N+1 th row using the over drive grayscale; if a displayed image of the display panel is normal, determining the predetermined over drive compensation coefficient to be the over drive compensation coefficient, and if the displayed image of the display panel is abnormal, adjusting the predetermined over drive compensation coefficient; and repeating the above steps until the over drive compensation coefficient is determined.

7. The driving method of the display panel of claim 2, wherein when the over drive grayscale of the pixel unit of the Nth row is a positive voltage, the over drive compensation coefficient is a first compensation coefficient, and when the over drive grayscale of the pixel unit of the Nth row is a negative voltage, the over drive compensation coefficient is a second compensation coefficient, and wherein the first compensation coefficient and the second compensation coefficient are not equal to each other.

8. The driving method of the display panel of claim 2, wherein the driving method of the display panel further comprises:

storing the standard over drive lookup table corresponding to the display panel and the over drive compensation coefficient.

9. The driving method of the display panel of claim 3, wherein the driving method of the display panel further comprises:

storing the standard over drive lookup table corresponding to the display panel and the over drive compensation coefficient.

10. The driving method of the display panel of claim 4, wherein the driving method of the display panel further comprises:

storing the standard over drive lookup table corresponding to the display panel and the over drive compensation coefficient.

11. The driving method of the display panel of claim 5, wherein the driving method of the display panel further comprises:

storing the standard over drive lookup table corresponding to the display panel and the over drive compensation coefficient.

12. The driving method of the display panel of claim 6, wherein the driving method of the display panel further comprises:

storing the standard over drive lookup table corresponding to the display panel and the over drive compensation coefficient.

13. The driving method of the display panel of claim 7, wherein the driving method of the display panel further comprises:

storing the standard over drive lookup table corresponding to the display panel and the over drive compensation coefficient.

14. A driving apparatus configured to drive a display panel, wherein the driving apparatus comprises:

a first acquiring module configured to, during a display period of one frame, acquire an actual charge grayscale of a pixel unit of an Nth row and a target grayscale of a pixel unit of an N+1th row, wherein the pixel unit of the Nth row and the pixel unit of the N+1 th row are connected to a same data line;

a second acquiring module connected to the first acquiring module and configured to, according to the actual charge grayscale of the pixel unit of the Nth row and the target grayscale of the pixel unit of the N+1 th row, acquire an over drive grayscale of the pixel unit of the N+1 th row; and a drive module configured to drive the pixel unit of the N+1 th row using the over drive voltage corresponding to the over drive grayscale.

15. The driving apparatus of claim 14, wherein the first acquiring module comprises an acquiring unit and a calculating unit;

wherein the acquiring unit is configured to acquire a target grayscale of the pixel unit of the Nth row, an over drive grayscale of the pixel unit of the Nth row, and an over drive compensation coefficient of the pixel unit of the Nth row; and wherein the calculating unit is configured to, according to the target grayscale of the pixel unit of the Nth row, the over drive grayscale of the pixel unit of the Nth row, and the over drive compensation coefficient of the pixel unit of the Nth row, calculate the actual charge grayscale of the pixel unit of the Nth row.

16. The driving apparatus of claim 15, wherein the driving apparatus further comprises a storage module, and wherein the storage module is configured to store a standard over drive lookup table corresponding to the display panel and the over drive compensation coefficient.

* * * * *